US008040026B2

(12) United States Patent
Shao et al.

(10) Patent No.: US 8,040,026 B2
(45) Date of Patent: Oct. 18, 2011

(54) ILLUMINATION LAMP WITH INNER LIGHT TUBE

(75) Inventors: Wei-Ping Shao, Keelung (TW); Ping-Sung Lu, Zhudong Township (TW); Shou-Yi Hung, Hsinchu (TW)

(73) Assignee: Candle Laboratory Co., Ltd, Gueishan Township (TW)

( * ) Notice: Subject to any disclaimer, the term of this patent is extended or adjusted under 35 U.S.C. 154(b) by 148 days.

(21) Appl. No.: 12/491,223

(22) Filed: Jun. 24, 2009

(65) Prior Publication Data

US 2010/0008084 A1 Jan. 14, 2010

(30) Foreign Application Priority Data

Jul. 8, 2008 (TW) ..... 97212108 U
May 1, 2009 (TW) ..... 98207483 U

(51) Int. Cl.
*H01J 17/04* (2006.01)
*H01J 61/30* (2006.01)

(52) U.S. Cl. ..... 313/17; 313/633; 313/634; 313/635; 313/636

(58) Field of Classification Search ..... 313/623–642
See application file for complete search history.

(56) References Cited

U.S. PATENT DOCUMENTS 1,275,890 A 8/1918 Flannery et al.
2,759,119 A 8/1956 Thorington
5,729,085 A * 3/1998 Sica et al. ..... 313/493
2003/0021117 A1 1/2003 Chan
2005/0184667 A1* 8/2005 Sturman et al. ..... 315/59
2005/0242736 A1 11/2005 Nomura et al.
2006/0273731 A1* 12/2006 Ge ..... 315/57
2007/0278931 A1* 12/2007 Mii ..... 313/489
2008/0007968 A1 1/2008 Lei et al.
2008/0113117 A1* 5/2008 Coenjarts et al. ..... 428/1.3

FOREIGN PATENT DOCUMENTS

DE 195 25 624 2/1996
EP 1 215 735 A1 6/2002
JP 2002-529900 9/2002
JP 2005-267971 9/2005
JP 2008-047539 2/2008
WO WO 2009/040111 4/2009

OTHER PUBLICATIONS

Extended European Search Report of European Application No. 09164958.2 dated May 13, 2011.

* cited by examiner

*Primary Examiner* — Anne Hines
*Assistant Examiner* — Tracie Green
(74) *Attorney, Agent, or Firm* — Dugan & Dugan, PC

(57) ABSTRACT

An illumination lamp is provided. The illumination lamp includes a hollow pillar tube being light-transmissive, at least one inner light tube accommodated in the hollow pillar tube, and an electrode set disposed at one distal end of the hollow pillar tube and electrically connected to the inner light tube in the hollow pillar tube.

14 Claims, 2 Drawing Sheets

ILLUMINATION LAMP WITH INNER LIGHT TUBE

RELATED APPLICATIONS

This application claims priority to both Taiwan Application Serial Number 97212108, filed Jul. 8, 2008, and Taiwan Application Serial Number 98207483, filed May 1, 2009, which are herein incorporated by reference.

BACKGROUND

1. Field of Invention

The present invention relates to an illumination device, more particularly to an illumination lamp.

2. Description of Related Art

Conventional fluorescent lamp tubes (i.e. Hot Cathode Fluorescent Lamps), are classified into Type T5~T12 in accordance with sizes and light capabilities. Normally, as compared to these lamp tubes among Type T5~T12, Type T8 lamp tubes are larger in size (25.4 mm in diameter), higher in power consumption (about 15-32 Watts), lower in light capability, longer in average product life (about 7,500-20,000 hours) and cheaper. Type 5 lamp tubes are new in generation, more compact in size (16 mm in diameter), lower in power consumption (about 8-13 Watts), higher in light capability, shorter in average product life (about 5,000 hours) and more expensive.

Although these conventional fluorescent lamp tubes fail to get improved power consumption, light capability, average product life and price, and fail to provide functions for proportional lightness modulation, these conventional fluorescent lamp tubes are used. Thus, whenever these fluorescent lamp tubes become useless and need to be dumped due to becoming obsolete or malfunction, these obsolete or malfunctioning lamp tubes are sometimes discarded or broken. Throwing these tubes away wastes society resources in dealing with debris of these lamp tubes.

Thus, issues are raised up on how the described disadvantage in high power consumption, low capability, short average product life and high price be solved, and how the waste of resources can be minimized.

SUMMARY

A first aspect of the present invention is to provide an illumination lamp.

The illumination lamp comprises a hollow pillar tube, at least one inner light tube, and an electrode set. The hollow pillar tube is light transmissive. The inner light tube is accommodated in the hollow pillar tube. The electrode set is disposed at one distal end of the hollow pillar tube, and is electrically connected to the inner light tube in the hollow pillar tube.

In an embodiment, the hollow pillar tube contains diffusion particles, phosphorescence particles or fluorescence particles.

In another embodiment, the hollow pillar tube is a tube made with transparent material in which a first diffusion layer is substantially fully coated on an inner surface of the tube. The inner light tube is a Cold Cathode Fluorescent Lamp (CCFL) or an Ultraviolet lamp (UV LAMP). The first diffusion layer contains diffusion particles, phosphorescence particles or fluorescence particles. The diffusion particles, phosphorescence particles or fluorescence particles is not only for evenly diffusing light emitted from the inner light tube, but also for transferring minor ultraviolet rays leaked from the inner light tube into visible light.

Thus, since the first diffusion layer on the inner surface of the hollow pillar tube is separated from some harmful substances in the inner light tube, compared to the conventional fluorescent lamp tubes, the possibility that the first diffusion layer gets damaged will be obviously decreased. Thus, the average product life of the first diffusion layer will be further increased, and fewer lamps will be thrown away due because of malfunctions thereby decreasing the environmental waste.

Therefore, a cheap lamp that consumes less power has high intensity capabilities and a long average product life is provided, and as in the embodiment which is compatible to furnish with a common fluorescent lamp holder. Thus, the lamp provides another option other than the current fluorescent lamp tubes to the market.

A second aspect of the present invention is to provide a combination of an inner light tube having inert gas therein and an empty fluorescent lamp tube. The empty fluorescent lamp tube has a layer of phosphorescence particles substantially fully coated on an inner surface thereof to evenly diffuse strong light emitted from the inner light tube.

In another embodiment, since an outer circumference of the emptied fluorescent lamp tube is larger than an outer circumference of the inner light tube, light emitted from the inner light tube around the outer circumference thereof can be amplified and diffused to output by the outer circumference of the emptied fluorescent lamp tube.

In this embodiment, the illumination lamp is suitable to a common fluorescent lamp holder because the illumination lamp has a same format as a common fluorescent lamp tube, thus, the illumination lamp can be set on the fluorescent lamp holder as a common fluorescent lamp tube could be. Thus, consumers can use the illumination lamp on the common fluorescent lamp holder, and do not need to purchase a new format of the fluorescent lamp holder.

BRIEF DESCRIPTION OF THE DRAWINGS

The structure and the technical means adopted by the present invention to achieve the above and other objectives can be best understood by referring to the following detailed description of the preferred embodiments and the accompanying drawings, where.

DESCRIPTION OF THE PREFERRED EMBODIMENTS

Figure 1:
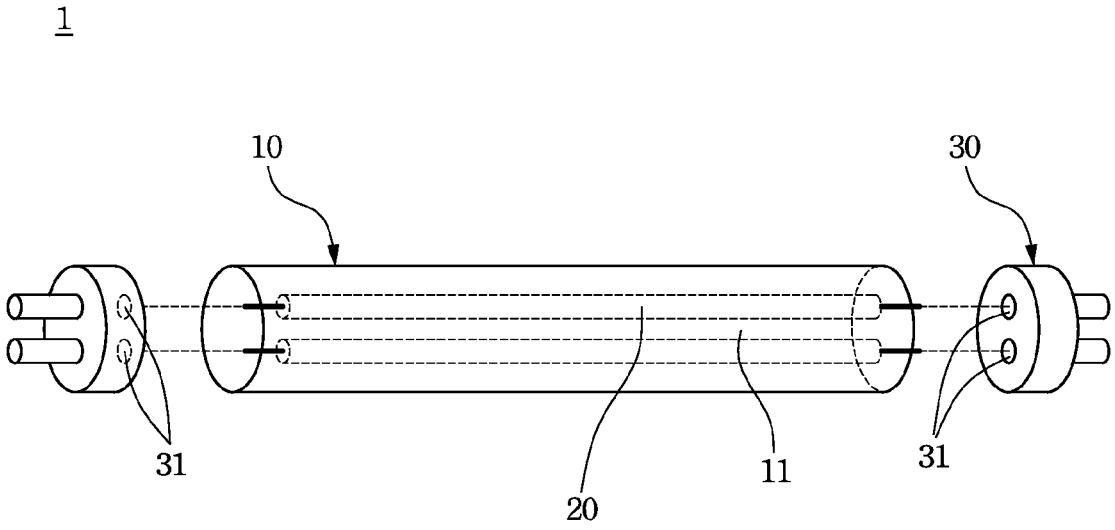
FIG. 1 is an exploded view illustrating one embodiment of the illumination light tube provided by the present invention.
Figure 2:
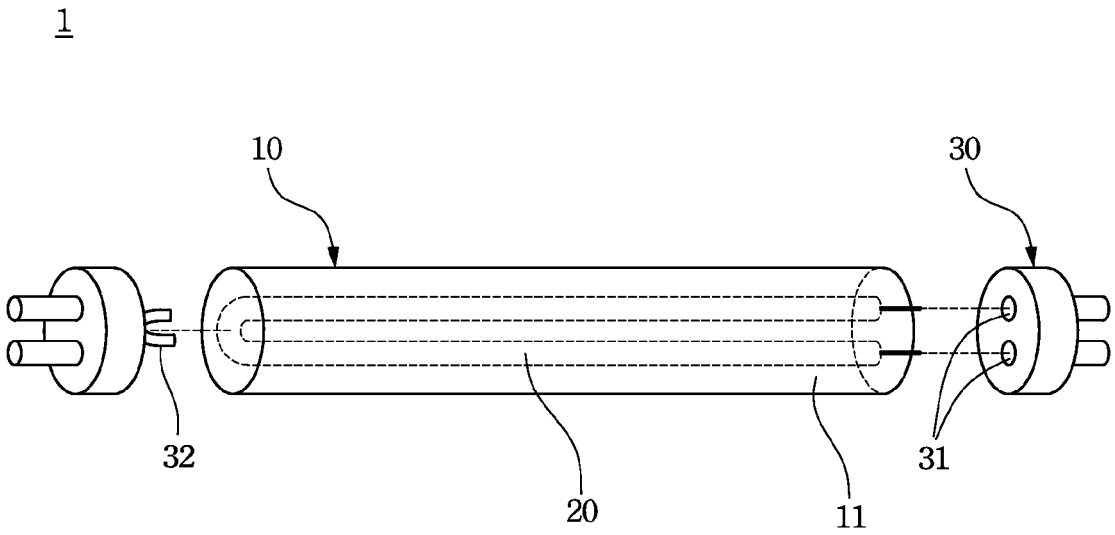
FIG. 2 is an exploded view illustrating another embodiment of the illumination light tube provided by the present invention.

Refer to FIG. 1 and FIG. 2. FIG. 1 is an exploded view illustrating one embodiment of the illumination light tube provided by the present invention. FIG. 2 is an exploded view illustrating another embodiment of the illumination light tube provided by the present invention.

In the embodiments, the present invention discloses an illumination light 1 that has a hollow pillar tube 10, one or more inner light tubes 20, and an electrode set 30. The hollow pillar tube 10 is light transmissive by visible light beams, and has a containing space 11 therein. Each of the inner light tubes 20 has inert gas 200 therein and is accommodated in the containing space 11.

The electrode set 30 has two electrodes 31. The electrodes 31 support and electrically connect the inner light tubes 20. The electrodes 31 are respectively disposed on two opposite distal ends of the hollow pillar tube 10 (see FIG. 1), or both disposed on the same distal end of the hollow pillar tube 10 (see FIG. 2). When the inner light tubes 20 are driven to emit lights by the electrode set 30, the hollow pillar tube 10 evenly diffuses the lights to provide well-mixed illumination around the hollow pillar tube 10.

Moreover, in FIG. 1, each of the inner light tubes 20 has a pillar-shaped profile, and is parallel to the hollow pillar tube 10. When the inner light tubes 20 are assembled in the hollow pillar tube 10, the electrodes 31 respectively electrically connect two opposite distal ends of each inner light tube 20 with a pillar-shaped profile.

In FIG. 2, the inner light tube 20 has a "U" shaped profile. When the inner light tube 20 is assembled in the hollow pillar tube 10, the electrodes 31 are respectively electrically connected to two opposite distal ends of each inner light tube 20 with the U shaped profile. In additions, the electrode set 30 further comprises a holder 32. The holder 32 holds a proper position of the inner light tube 20 with the U shaped profile. The holder 32 is disposed on another distal end of the hollow pillar tube 10 different from the distal end thereof that the electrodes 31 are disposed.

However, shapes of the inner light tube 20 appearing in FIG. 1 and FIG. 2 are only for exemplary expressions, does not mean that all kinds of the shapes have been shown in the present invention. Other shape such as spiral shaped profile can be implemented on the inner light tube 20.

The light tube(s) 20 can also be an Ultraviolet lamp (hereinafter called UV lamp 201) or a Cold Cathode Fluorescent Lamp (hereinafter called CCFL 202). Furthermore, the light tube(s) 20 can also be a mercuric-containing light tube or a mercuric-free light tube. A person who is skilled in the related art may select flexibly the types of the light tube(s) 20 in accordance with the feasible situations.

Furthermore, the inner light tube 20 (e.g. UV lamp 203 or CCFL 202) has properties of small size (1.6~6.5 mm in diameter), low power consumption, high light capability, and high average product life (about 20,000-50,000 hours). Since the inner light tube 20 is with a small size, thus, the inner light tube 20 emits as a string-like light source.

Figure 3A:
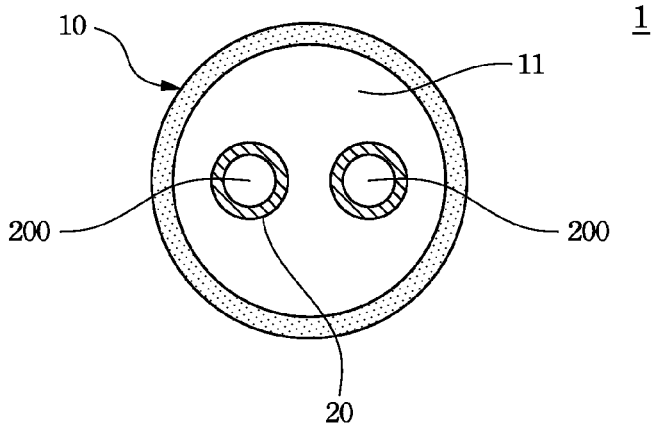
FIG. 3A is a cross-section view illustrating the other embodiment in the practices of the illumination light tube provided by the present invention.

Refer to FIG. 3A. FIG. 3A is a cross-section view illustrating the other embodiment of the illumination light tube provided by the present invention. In an embodiment of the practices in FIG. 1 and FIG. 2, the hollow pillar tube 10 inherently has light diffusion function, is made by material such as Poly(methyl methacrylate) (PMMA), Polystyrene (PS), Methyl methacrylate-co-styrene(MS), Polycarbonate (PC), Polyethylene Terephthalate (PET), or Polyimide, and the hollow pillar tube 10 contains diffusion particles, phosphorescence particles or fluorescence particles itself.

Figure 3B:
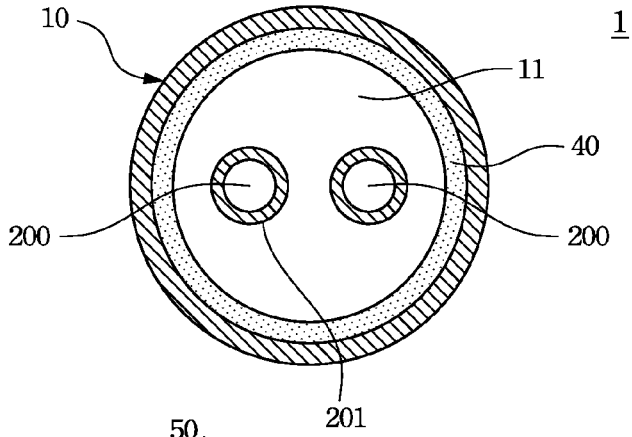
FIG. 3B is a cross-section view illustrating the other embodiment in the practices of the illumination light tube provided by the present invention.

Refer to FIG. 3B. FIG. 3B is a cross-section view illustrating the other embodiment of the present invention. In the embodiment, the mentioned light tube 20 is a UV lamp 201, and the hollow pillar tube 10 is a tube made with light-transmissive material in which a first diffusion layer 40 is fully coated on an inner surface of the tube.

Figure 3C:
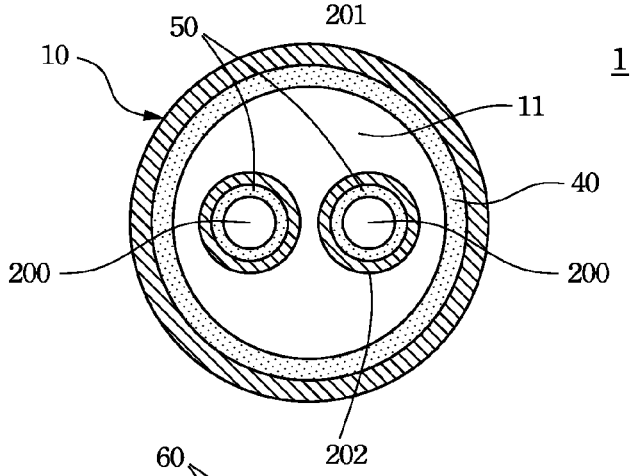
FIG. 3C is a cross-section view illustrating the other embodiment in the practices of the illumination light tube provided by the present invention.

Refer to FIG. 3C. FIG. 3C is a cross-section view illustrating the other embodiment of the illumination light tube provided by the present invention. In the embodiment, the UV lamp 201 has a second diffusion layer 50 fully coated on an inner surface of the UV lamp 201 for becoming to a CCFL 202, in which the second diffusion layer 50 is able to transfer UV light emitted from the UV lamp 201 into visible light. When the CCFL 202 is accommodated in the hollow pillar tube 10 coated with the first diffusion layer 40 on the inner surface of the hollow pillar tube 10, since an outer circumference of the hollow pillar tube 10 is larger than an outer circumference of the CCFL 202, the visible light of the string-like light source can be amplified, diffused and harmonized on the outer circumference of the hollow pillar tube 10.

On the other way, refer to FIG. 3B again. When the UV lamp 201 without the second diffusion layer 50 therein is accommodated in the hollow pillar tube 10 coated with the first diffusion layer 40, the first diffusion layer 40 is able to transfer UV light emitted from the UV lamp 201 into visible light instead of the second diffusion layer 50. Since an outer circumference of the hollow pillar tube 10 is larger than an outer circumference of the UV lamp 201, after the UV light of the UV lamp 201 is transferred into visible light, the first diffusion layer 40 provides the hollow pillar tube 10 as a tube-like light source. Thus, the visible light of the tube-like light source can be diffused and harmonized on the outer circumference of the hollow pillar tube 10.

Figure 3D:
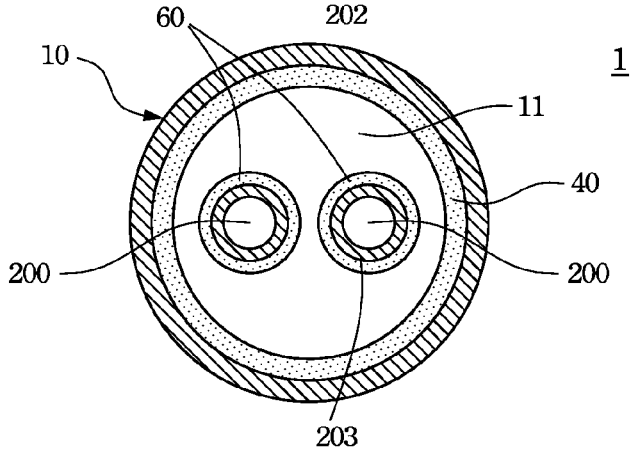
FIG. 3D is a cross-section view illustrating the other embodiment in the practices of the illumination light tube provided by the present invention.

Furthermore, refer to FIG. 3D. FIG. 3D is a cross-section view illustrating the other embodiment in the practices of the illumination light tube provided by the present invention. In the embodiment, the mentioned light tube 20 is another UV lamp 203 accommodated in the hollow pillar tube 10, and the UV lamp 203 has a third diffusion layer 60 fully coated on an outer surface of the UV lamp 203. The UV lamp 203 is able to transfer UV light emitted from the UV lamp 203 into visible light for providing a string-like light source.

Since an outer circumference of the hollow pillar tube 10 is larger than an outer circumference of the UV lamp 203, the visible light of the string-like light source can be amplified, diffused and harmonized as well on the outer circumference of the hollow pillar tube 10.

The mentioned first, second, and third diffusion layer 40, 50, 60 respectively contain diffusion particles, phosphorescence particles or fluorescence particles. The diffusion particles, phosphorescence particles or fluorescence particles is not only for evenly diffusing light emitted from the inner light tube 20, but also for transferring a minor of ultraviolet rays leaked from the inner light tube 20 into visible light.

Since the first diffusion layer 40 on the inner surface of the hollow pillar tube 10 is separated from some harmful substances in the inner light tube 20, comparing to the conventional fluorescent lamp tubes, possibilities that the first diffusion layer 40 got damaged will be obviously decreased. Thus, an average product life of the illumination lamp 10 will be further increased.

The shapes of the inner light tube 20 can be respectively combine with any one embodiment in FIG. 3A to FIG. 3D, e.g. the UV lamp 203 in FIG. 3D can be shown as pillar-shaped profile or "U" shaped profile.

Refer to FIG. 1 again. In another practice of the invention, the hollow pillar tube 10 can be limited into an empty fluorescent lamp tube. For example, when the fluorescent lamp tube is unsealed and its inert gas, mercury vapor and phosphorescence sludge therein have come off from the fluorescent lamp tube, a first diffusion layer 40 can be coated again on an inner surface of the empty fluorescent lamp tube. Thus, a so-called hollow pillar tube 10 with the first diffusion layer 40 is prepared easily rather than additionally producing an empty tube with the diffusion layer 40 thereon.

Furthermore, the illumination lamp 10 is suitable to a common fluorescent lamp holder because the electrode set 30 has a form/standard compatible to the common fluorescent lamp tube. Thus, the electrode set 30 is able to engage the common fluorescent lamp holder as the common fluorescent lamp tube does. Thus, consumers do not need to purchase a new fluorescent lamp holder in relative to the same format of the illumination lamp 10, and utilize the illumination lamp 10 in the practices on the common fluorescent lamp holder.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An illumination lamp, comprising:

a hollow cylinder tube being light-transmissive, and the hollow cylinder tube has a diffusion layer fully coated on an inner surface of the hollow cylinder tube;

at least one inner light tube accommodated in the hollow cylinder tube, wherein the at least one inner light tube has a diffusion layer fully coated on an outer surface thereof; and an electrode set disposed at one distal end of the hollow cylinder tube and electrically connected to the inner light tube.

2. The illumination lamp as claimed in claim 1, wherein the diffusion layer comprises particles of phosphorescence, polystyrene or poly (methyl methacrylate).

3. The illumination lamp as claimed in claim 1, wherein the hollow cylinder tube comprises one selecting from a group consisting of Poly(methyl methacrylate), Polystyrene, Methyl methacrylate-co-styrene, Polycarbonate, Polyethylene Terephthalate, Polyimide and combinations thereof.

4. The illumination lamp as claimed in claim 1, wherein the at least one inner light tube is mercuric-containing.

5. The illumination lamp as claimed in claim 1, wherein the at least one inner light tube is mercuric-free.

6. The illumination lamp as claimed in claim 1, wherein the at least one inner light tube is a cylinder with a straight profile.

7. The illumination lamp as claimed in claim 6, wherein the electrode set comprises two electrodes respectively disposed at two opposite distal ends of the hollow cylinder tube, and respectively electrically connected two opposite distal ends of the at least one inner light tube.

8. The illumination lamp as claimed in claim 1, wherein the at least one inner light tube is a cylinder with a "U"-shaped profile.

9. The illumination lamp as claimed in claim 8, wherein the electrode set comprises two electrodes respectively disposed at the same distal end of the hollow cylinder tube, and respectively electrically connected two opposite distal ends of the at least one inner light tube.

10. The illumination lamp as claimed in claim 8, wherein the electrode set further comprises a holder disposed on another distal end of the hollow cylinder tube for physically holding the at least one inner light tube.

11. An illumination lamp, comprising:

an empty fluorescent lamp tube having a cylinder shape, and a layer of phosphorescence particles fully coated on an inner surface of the empty fluorescent lamp tube;

at least one inner light tube accommodated in the empty fluorescent lamp tube wherein the at least one inner light tube has a diffusion layer fully coated on an outer surface thereof; and an electrode set compatible to a fluorescent lamp holder, having two electrodes both holding and electrically connected to one distal ends of the inner light tube, wherein the electrode set is disposed on one distal end of the empty fluorescent lamp tube.

12. The illumination lamp as claimed in claim 11, wherein the at least one inner light tube is a Cold Cathode Fluorescent Lamp or an Ultraviolet lamp.

13. The illumination lamp as claimed in claim 11, wherein the at least one inner light tube is a cylinder with a straight profile, and another one of the electrodes is disposed on another distal end of the empty fluorescent lamp tube.

14. The illumination lamp as claimed in claim 11, wherein the at least one inner light tube is cylinder with a "U" shaped profile, the electrodes are disposed at the same distal end of the hollow pillar tube, and the electrode set further comprises a holder for holding the at least one inner light tube, the holder is disposed on another distal end of the empty fluorescent lamp tube different from the distal end thereof that the electrodes are disposed.

* * * * *